United States Patent [19]

Garner, Sr.

[11] Patent Number: 4,523,762

[45] Date of Patent: Jun. 18, 1985

[54] GAME APPARATUS

[76] Inventor: Ronald S. Garner, Sr., P.O. Box 545, Dayton, Ohio 45402

[21] Appl. No.: 660,343

[22] Filed: Oct. 12, 1984

[51] Int. Cl.[3] ..... A63B 71/02

[52] U.S. Cl. ..... 273/411; 273/58 C; 273/413

[58] Field of Search ..... 273/411, 26 E, 26 EA, 273/58 C, 413, 29 A

[56] References Cited

U.S. PATENT DOCUMENTS

| | | | |
|---|---|---|---|
| 1,708,796 | 4/1929 | Lawrence | 273/29 A |
| 2,769,636 | 11/1956 | Finestone | 273/413 X |
| 3,351,343 | 11/1967 | Papp | 273/26 E |
| 3,809,406 | 5/1974 | Lohr et al. | 273/413 |
| 3,924,855 | 12/1975 | Pretorius | 273/413 |
| 4,186,921 | 2/1980 | Fox | 273/58 C X |
| 4,216,960 | 8/1980 | Nicholls | 273/29 A |
| 4,270,757 | 6/1981 | Ligon | 273/411 |
| 4,342,459 | 8/1982 | Pretorius | 273/413 |
| 4,352,497 | 10/1982 | Warehime | 273/411 |
| 4,372,561 | 2/1983 | Morgan et al. | 273/411 |

FOREIGN PATENT DOCUMENTS

| | | | |
|---|---|---|---|
| 206999 | 11/1923 | United Kingdom | 273/413 |
| 297660 | 9/1928 | United Kingdom | 273/413 |
| 408160 | 4/1934 | United Kingdom | 273/29 A |

*Primary Examiner*—William H. Grieb

*Attorney, Agent, or Firm*—Biebel, French & Nauman

[57] ABSTRACT

A game apparatus includes a generally rectangular playing field defined within a pair of spaced, parallel baselines and a pair of spaced, parallel sidelines. A pair of support posts are positioned outside the playing field, each such post being positioned adjacent the midpoint of a respective one of the sidelines. A support line extends between the pair of support posts and is attached to the posts adjacent their upper ends. The support line bisects the playing field and extends generally aparallel to the baselines. A tether line is attached to the support line by means of a tether line ring. A playing ball is attached to the opposite end of the tether line, whereby the playing ball may be struck by one or more players on either side of the support line and caused to travel repeatedly over the support line.

12 Claims, 19 Drawing Figures

GAME APPARATUS

BACKGROUND OF THE INVENTION

The present invention relates to athletic games and, more particularly, to game apparatus which may be set up in a relatively small area, played by teams including a number of players, and in which movement of the game ball is restrained by a tether line.

Various games have been developed in which a ball, similar to a volley ball or a soccer ball, is tethered. Games of this sort are ideal for confined areas, such as a small, residential back yard, in that the movement of the ball is restricted. It is well known to attach a tethered ball to an upright pole. With such apparatus, the ball is struck with the hand or fist during play of the game and the tethered ball rotates around the support pole in a relatively limited arc of travel. Thus, such a game is not appropriate for play by more than a few players.

U.S. Pat. No. 4,352,497, issued Oct. 5, 1982, to Warehime discloses a tethered ball arrangement for practicing soccer. In one embodiment, a pair of balls, defining a goal therebetween, are attached together by a tether line. Also attached to the tether line is a rope which is attached, at its opposite end, to the game ball.

While games using a tethered ball have been played in confined areas, a need exists for game apparatus which permits play by a number of players simultaneously, which facilitates eye-hand coordination and player movement, and which is simple and durable in construction.

SUMMARY OF THE INVENTON

Game apparatus includes a generally rectangular playing field defined within a pair of spaced, parallel baselines, and a pair of spaced, parallel sidelines. A pair of support posts are positioned outside the playing field. The posts each are positioned adjacent the midpoint of a respective one of the sidelines. A support line extends between the pair of support posts and is attached to the posts adjacent their upper ends. The support line bisects the playing field and extends generally parallel to the baselines. A tether line means is attached at its first end to a tether line ring which engages the support line. A playing ball is attached to the second end of the tether line means, whereby the playing ball may be struck by one or more players on either side of the support line and caused to travel repeatedly over the support line.

The tether line ring may comprise an inner, annular ring encircling the support line, and an outer, annular ring engaging the first end of the tether line means. The outer, annular ring surrounds the inner, annular ring and is substantially concentric therewith. A plurality of support spokes extend between the inner, annular ring and the outer, annular ring.

The tether line means may comprise a single tether line. Alternatively, the tether line means may comprise a pair of tether lines.

The playing ball may include an inflatable ball, and an attachment means, secured to the inflatable ball, for engaging the second end of the tether line means. The attachment means may comprise a plate which is adhesively attached to the inflatable ball and which defines at least one slot for receiving the second end of the tether line means. The tether line means may comprise a pair of tether lines. In such a case, the plate defines a pair of slots, each of which receives a respective one of the tether lines.

The attachment means may include one or more bands encircling the inflatable ball and defining at least one slot for engaging the second end of the tether line means.

The generally rectangular playing field may be divided into a plurality of sections of equal size by lines extending parallel to the sidelines between the baselines. Each half of the playing field to either side of the support line may be divided into side courts adjacent the sidelines and a midcourt therebetween. Each of the side courts and midcourts is, in turn, divided into a front area adjacent the support line and a rear area adjacent a baseline. The front area and the rear area are substantially equal in size.

The game apparatus may further include limit means, attached to the support line inwardly from each of the support posts, for limiting movement of the tether line ring along the support line.

Accordingly, it is an object of the present invention to provide game apparatus which includes a tethered game ball for play in areas of restricted size; to provide such game apparatus which may be played simultaneously by a number of players; to provide such game apparatus in which player eye-hand coordination and agility are enhanced; and to provide such game apparatus which is simple in construction.

Other objects and advantages of the invention will be apparent from the following description, the accompanying drawings and the appended claims.

DETAILED DESCRIPTION OF THE PREFERRED EMBODIMENT

Figure 1:
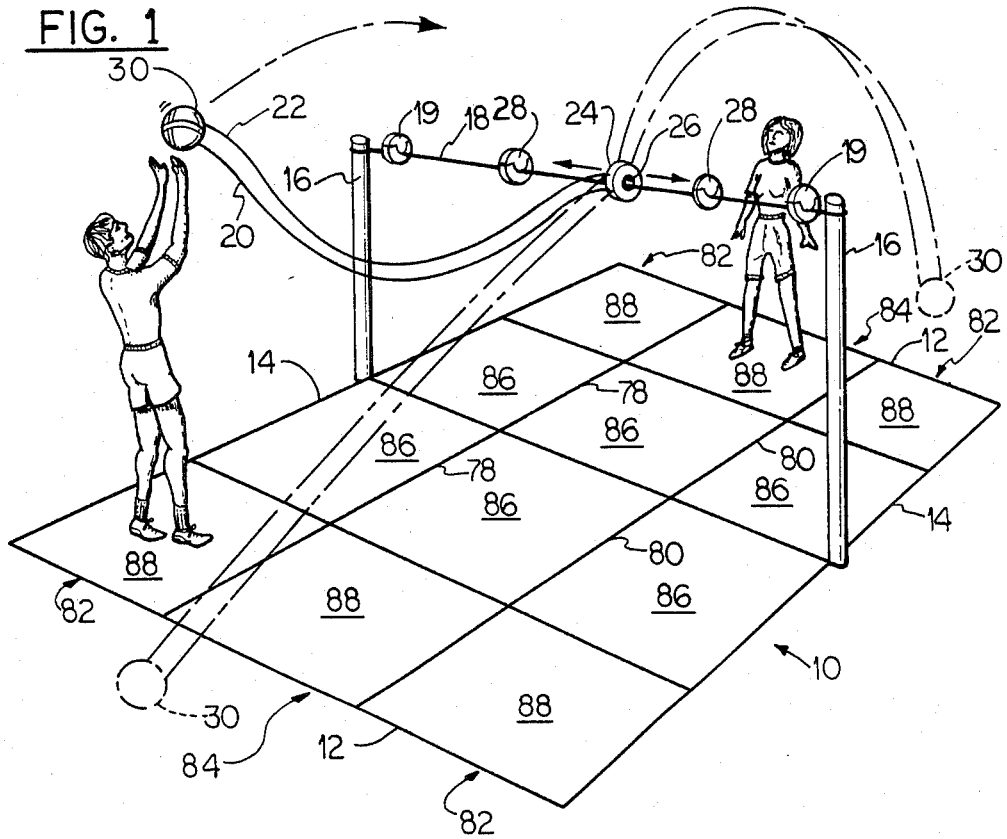
FIG. 1 is a perspective view of the game apparatus, illustrating its general construction.

FIG. 1 illustrates the general construction of the game apparatus of the present invention. The apparatus includes a generally rectangular playing field 10 which is defined within a pair of spaced, parallel baselines 12, and a pair of spaced, parallel sidelines 14. The baselines are approximately 21 feet long and the sidelines are approximately 20 feet long. A pair of support posts 16 are positioned outside the playing field. Each of the posts 16 is positioned adjacent the midpoint of a respective one of the sidelines 14.

A support line 18 extends between the pair of support posts 16 and is attached to the posts adjacent their upper ends approximately six feet above the playing field. The support line 18 bisects the playing field and extends generally parallel to the baselines 12. The support line 18 is a rope or cable made of nylon or other suitable material. The support line preferably extends through openings in the upper ends of the support posts 16. The ends of the support lines extending from the openings in the posts 16 are clamped to the main portion of the support line 18 by means of rope clamps 19. Appropriate clamps for this use are disclosed in applicant's copending application Ser. No. 660,342 filed Oct. 12, 1984, CABLE OR ROPE CONNECTION INCLUDING CLAMP DEVICE. Alternatively, the free ends of the support line may be tied to the main portion of the support line 18 or attached to the support posts in any other known fashion.

A tether line means including tether lines 20 and 22 is attached at its first end to a tether line ring 24 which engages the support line 18. The tether lines 20 and 22 are approximately 14 feet in length. Tether line ring 24 defines a center opening 26 through which the support line 18 extends. The opening 26 is substantially larger than the support line 18 such that the tether line ring 24 is free to rotate and to move along the support line 18 between the limits 28. Limits 28, described below, are secured to support line 18. A playing ball 30 is attached to the second end of the tether line means. As shown by the representations of the playing ball 30 and the tether line means in solid and dashed lines in FIG. 1, the playing ball may be struck by one or more players on either side of the support line 18 and caused to travel repeatedly over the support line 18 in a manner similar to play in volley ball.

Figure 2:
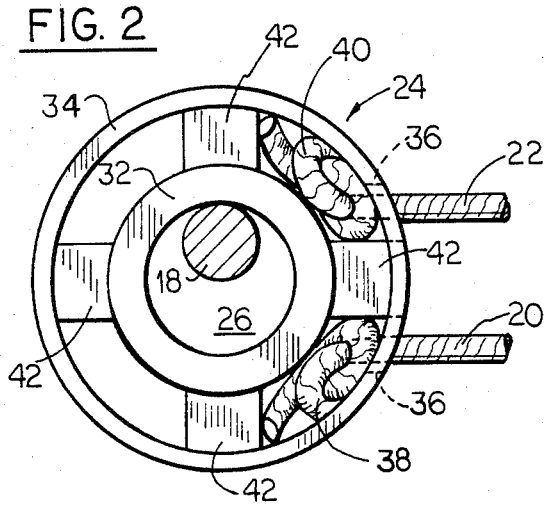
FIG. 2 is a side view of a tether line ring, with the support line in section.
Figure 3:
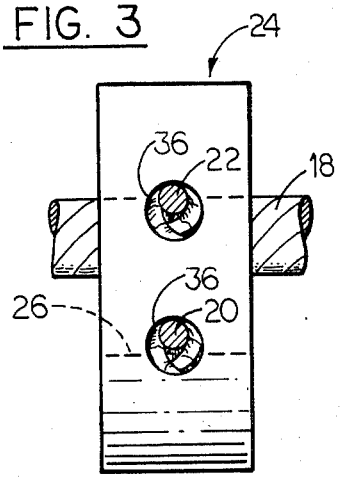
FIG. 3 is a view of the tether line ring, as seen looking right to left in FIG. 2, with the tether lines in section.
Figure 4:
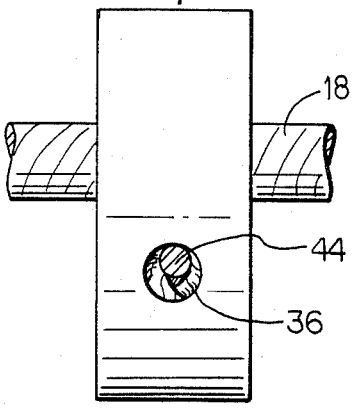
FIG. 4 is a view similar to FIG. 3 of a tether line ring for use with a single tether line.

The tether line ring 24 is shown in FIGS. 2 and 3 in greater detail. The ring includes an inner, annular ring 32 encircling the support line 18 and an outer, annular ring 34 which engages the first end of the tether line means. The outer, annular ring 34 surrounds the inner, annular ring 32 and is substantially concentric therewith. The tether lines 20 and 22 extend through openings 36 and are secured to the tether line ring 24 by knots 38 and 40 which are substantially larger than the openings 36. A plurality of support spokes 42 extend between the inner, annular ring 32 and the outer, annular ring 34. In an alternative configuration of the game apparatus, only a single tether line 44 is used to attach the ball 30 to the tether line ring 24. For such an arrangement, the ring 24 may be reconfigured as shown in FIG. 4 with only a single opening 36.

Figure 5:
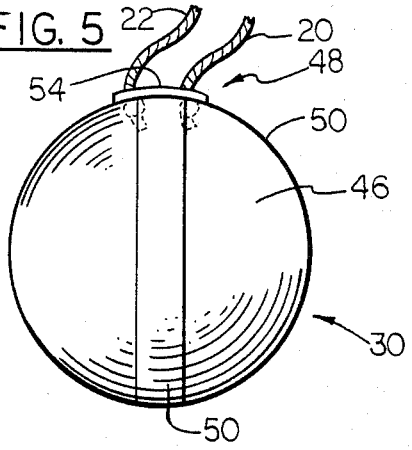
FIG. 5 is a side view of a playing ball.
Figure 6:
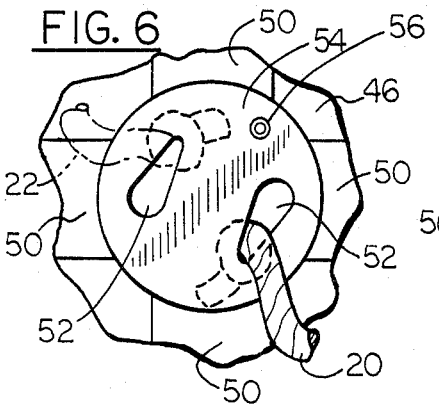
FIG. 6 is an enlarged view of a plate, defining a pair of slots, which is attached to the playing ball and which provides a mechanism for attachment to a pair of tether lines.
Figure 7:
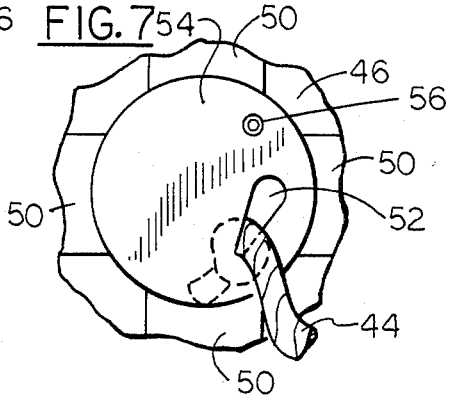
FIG. 7 is a view similar to FIG. 6, showing a plate for attachment to a single tether line.

FIG. 5 is a side view showing one type of playing ball which may be used in the present invention. The playing ball includes an inflatable ball 46 and an attachment means 48 which is secured to the inflatable ball 46 and which engages the second end of the tether lines 20 and 22. The attachment means may include one or more bands 50 which encircle the inflatable ball 46 and which, as shown in FIGS. 6 and 7, define one or more slots 52 for engaging the second ends of the tether lines 20 and 22 or 44. The slots 52 are defined within a plate 54 which is secured to the inflatable ball 46 by the bands 50. Plate 54 may, alternatively, be adhesively secured to the inflatable ball.

In either event the knotted ends of the tether lines are inserted in the slot or slots 52 prior to inflation of the ball 46. The knots are then securely engaged within the slots 52 after the ball 46 is fully inflated. The ball 46 may be made of rubber or other appropriate synthetic material and is inflatable through a fill valve 56 of conventional design.

Figure 8:
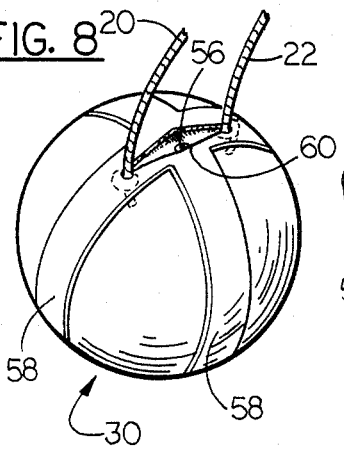
FIG. 8 is a view of an alternative playing ball arrangement.
Figure 9:
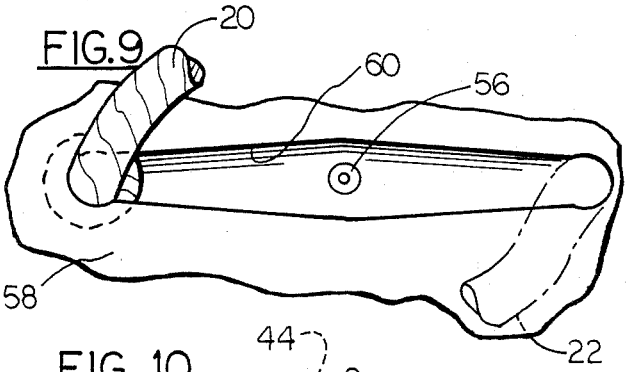
FIG. 9 is an enlarged view illustrating a slot in the bands encircling the playing ball of FIG. 8.
Figure 10:
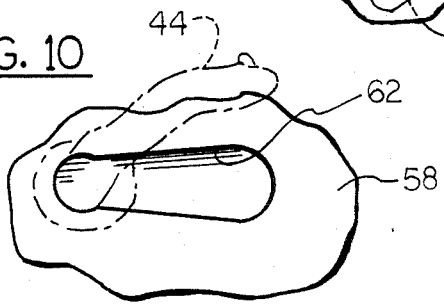
FIG. 10 is an enlarged view, illustrating a modification in the slot of FIG. 9.

An alternative construction for the playing ball 30 is shown in FIGS. 8–10. In this construction, the bands 58 define a single slot 60 within which both of the tether lines 20 and 22 are received. Note that the plate 54, utilized in the embodiment of FIGS. 5–7, is eliminated from this structure. Slot 60 is widest adjacent its center area and tapered toward each end so as to receive both of the tether lines. If desired, fill valve openings 56 may be positioned in the slots 60. FIG. 10 illustrates a slightly modified version of the playing ball of FIGS. 8 and 9 in which the bands 58 define a slot 62 which is tapered toward only one of its ends. This version is intended for use with game apparatus having only a single tether line 44.

Figure 11:
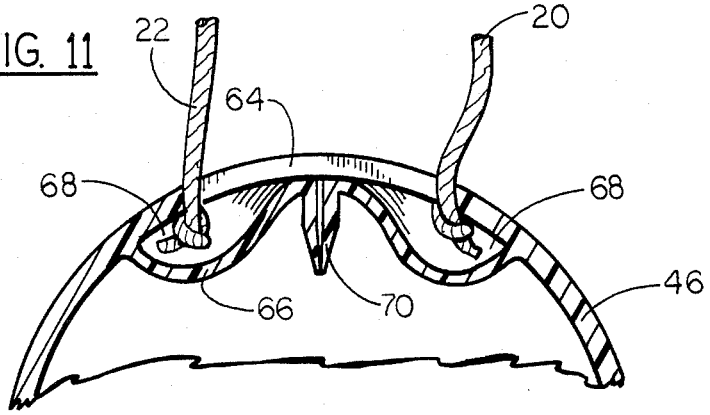
FIG. 11 is a partial sectional view, illustrating a further embodiment of the playing ball of the present invention.

Yet another configuration of playing ball is illustrated in the partial sectional view of FIG. 11, in which the bands 50 and 58 are eliminated and the slot 64 is defined within the ball itself. An inner layer 66 completely bridges the slot 64 and defines pockets 68 into which the knotted ends of the tether lines 20 and 22 are received prior to full inflation of the ball 46. As shown, the layer 66 may also define a fill valve 70.

Figure 12:
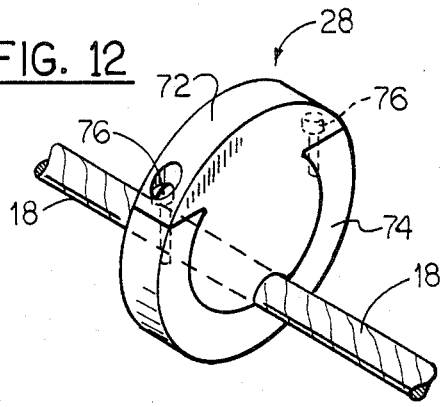
FIG. 12 is an enlarged perspective view of a limit clamp which attaches to the support line and which limits movement of the tether line ring along the support line.
Figure 13:
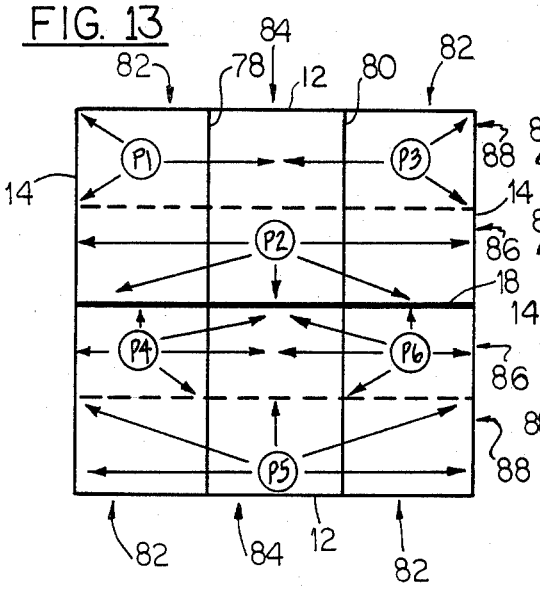
FIGS. 13–16 are diagrammatic views of the playing field which illustrate play of the game by three players on each team.
Figure 14:
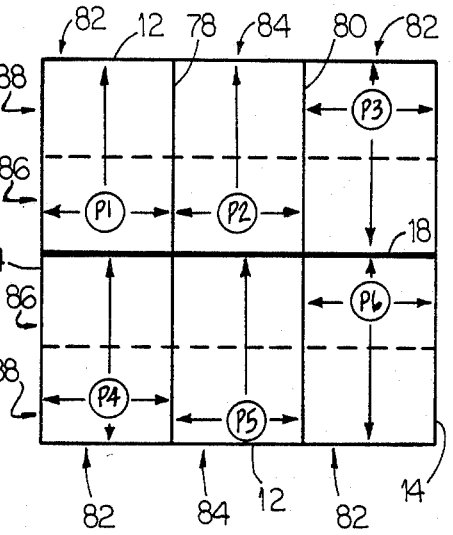
Figure 15:
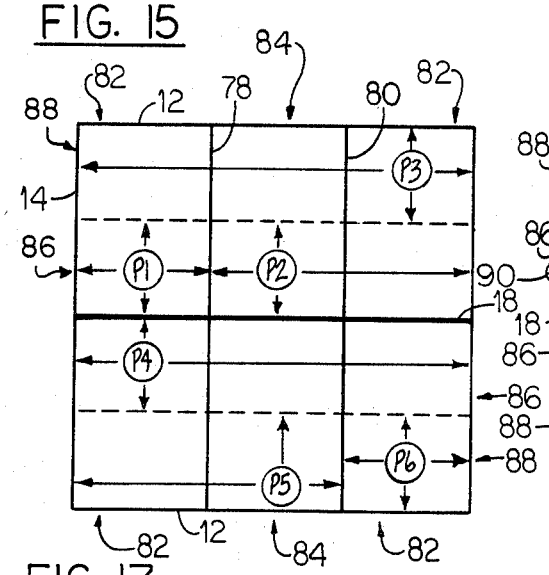

FIG. 12 illustrates one construction for the limit 28 which, as mentioned earlier, is attached to the support line 18 inwardly from each of the support posts 16 so as to limit movement of the tether line ring 24 along the support line. The limit means consists of an upper element 72 and a lower element 74 which are attached together by means of threaded bolts 76, thereby clamping the line 18 therebetween.

The generally rectangular playing field, as shown in FIG. 1 and FIGS. 13–16, is divided into a plurality of sections by lines 78 and 80 which extend parallel to the sidelines 14 between the baselines 12. Lines 78 and 80 divide each half of the playing field to either side of the support line 18 into side courts 82 adjacent the sidelines 14 and a midcourt 84 therebetween. Each of the side courts and midcourts is divided into a front area 86 adjacent the support line 18 and a rear area 88 adjacent a baseline 12. The front area 86 and tne rear area 88 are substantially equal in size.

It has been found that the game apparatus described above lends itself to playing a number of different challenging and exciting games. FIGS. 13–16 illustrate player movement patterns with two teams of three players each. Play is initiated by the player in the midcourt (for example, player P5 in FIG. 13) serving the playing ball in volley ball style over the support line 18 from behind the baseline 12. The receiving team, consisting of players P1, P2, and P3, must then strike the ball to cause it to pass back over the support line 18 and into the serving team's half of the playing field. Each team can strike the ball no more than twice before causing it to pass over the support line. Additionally, no player can strike the ball twice in a row.

Figure 16:
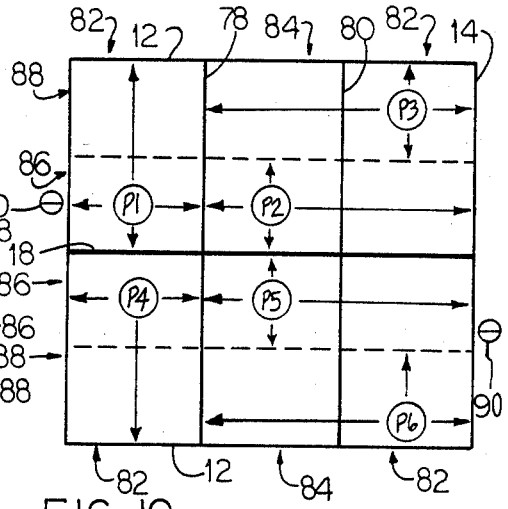

If the playing ball 30 is not caused to pass over the support line in the required fashion, or if it lands outside of the playing field defined by the baselines 12 and the sidelines 14, a point is awarded to the opposing team. When a serving team wins a point, it continues to serve, with change of serve occurring only when a point is lost by the serving team. An added challenge to the game is created by a rule requiring no more than two players in a team to be in the front area or the rear area at the time that the ball is struck by a team member. Thus, the three players must be positioned as shown in FIGS. 13–16 in a staggered arrangement. Further, one player must be positioned in each side court and in the midcourt. Players may change their respective positions between successive strikes of the ball. If desired, it may be helpful to provide a pair of referees 90 as shown in FIG. 16 in order to ensure that the player formations are properly maintained. Failure to comply with player formation rules results in the award of a point to the opposite team.

Play continues in this fashion until one of the teams reaches a score of 21. If desired, the rules may provide that the game is awarded if one team reaches 7 points before the opposing team scores a point, or if one team reaches 14 points before the opposing team scores 5 points. As a supplementary rule, it may be required that the winning team yell "Ace," "Best," or "Game," upon reaching the 7—0, 14—4, or 21 point winning scores, respectively. If the winning team fails to yell the appropriate word, then play continues.

Figure 17:
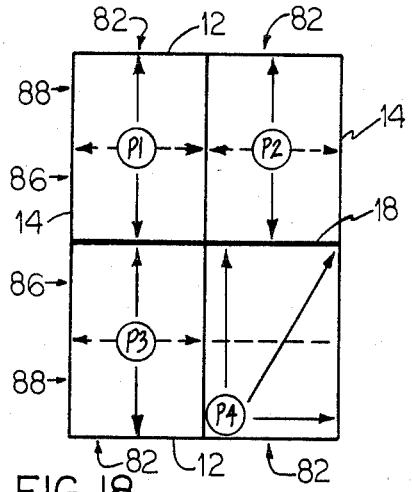
FIGS. 17 and 18 are diagrammatic views of the playing field which illustrate play of the game by two players on each team.
Figure 19:
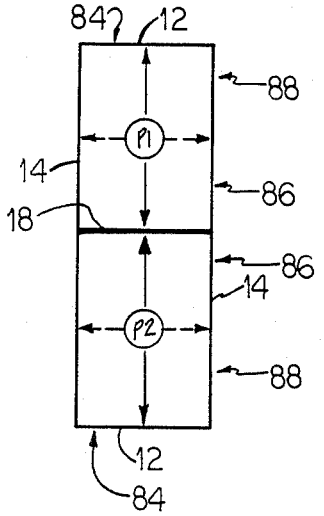
FIG. 19 is a diagrammatic view of the playing field which illustrates play of the game by one player on each team.
Figure 18:
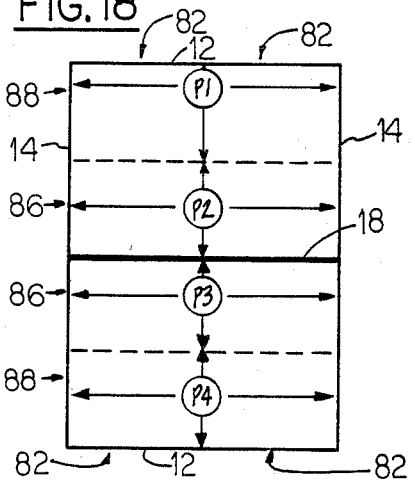

FIG. 17 and FIG. 18 illustrate player patterns where the teams consist of two players each. In this case, only a pair of side courts 82 are utilized, with no midcourt. FIG. 19 illustrates the court configuration for playing only one player per team. Only the midcourt 84 is utilized for such a game.

While the form of apparatus herein described constitutes a preferred embodiment of this invention, it is to be understood that the invention is not limited to this precise form of apparatus, and that changes may be made therein without departing from the scope of the invention which is defined in the appended claims.

What is claimed is:

1. Game apparatus, comprising:

a generally rectangular playing field defined within a pair of spaced, parallel baselines and a pair of spaced, parallel sidelines, a pair of support posts positioned outside said playing field, said posts each being positioned adjacent the midpoint of a respective one of said sidelines, a support line extending between said pair of support posts and attached to said posts adjacent their upper ends, said support line bisecting said playing field and extending generally parallel to said baselines, a tether line means, a tether line ring engaging said support line and attached to a first end of said tether line means, and a playing ball attached to the second end of said tether line means, whereby said playing ball may be struck by one or more players on either side of said support line and caused to travel repeatedly over said support line.

2. The game apparatus of claim 1 in which said tether line ring comprises:

an inner, annular ring encircling said support line, an outer, annular ring engaging said first end of said tether line means, said outer, annular ring surrounding said inner, annular ring and substantially concentric therewith, and a plurality of support spokes extending between said inner, annular ring and said outer, annular ring.

3. The game apparatus of claim 1 in which said tetner line means comprises a single tether line.

4. The game apparatus of claim 1 in which said tether line means comprises a pair of tether lines.

5. The game apparatus of claim 1 in which said playing ball includes an inflatable ball, and attachment means, secured to said inflatable ball, for engaging said second end of said tether line means.

6. The game apparatus of claim 5 in which said attachment means comprises a plate adhesively attached to said inflatable ball and defining at least one slot for receiving said second end of said tether line means.

7. The game apparatus of claim 6 in which said tether line means comprises a pair of tether lines and in which said plate defines a pair of slots, each of which receives a respective one of said tether lines.

8. The game apparatus of claim 5 in which said attachment means includes one or more bands encircling said inflatable ball and defining at least one slot for engaging said second end of said tether line means.

9. The game apparatus of claim 1 in which said generally rectangular playing field is divided into a plurality of sections of equal size by lines extending parallel to said sidelines between said baselines.

10. The game apparatus of claim 9 in which each half of said playing field to either side of said support line is divided into side courts adjacent said sidelines and a midcourt therebetween.

11. The game apparatus of claim 10 in which each of said side courts and midcourts is divided into a front area adjacent the support line and a rear area adjacent a baseline, said front area and said rear area being substantially equal in size.

12. The game apparatus of claim 1 further comprising limit means, attached to said support line inwardly from each of said support posts, for limiting movement of said tether line ring along said support line.

* * * * *